US007484985B2

(12) United States Patent
Wang et al.

(10) Patent No.: US 7,484,985 B2
(45) Date of Patent: Feb. 3, 2009

(54) SOCKET CONNECTOR TERMINALS

(75) Inventors: Qing-Feng Wang, ShenZhen (CN); Fu-Jin Peng, ShenZhen (CN); Yao-Chi Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/980,895

(22) Filed: Oct. 31, 2007

(65) Prior Publication Data

US 2008/0101047 A1 May 1, 2008

(30) Foreign Application Priority Data

Oct. 31, 2006 (CN) ..... 2006 2 0126674

(51) Int. Cl.
*H01R 4/50* (2006.01)

(52) U.S. Cl. ..... 439/342; 439/733.1; 439/857

(58) Field of Classification Search ..... 439/342, 439/733.1, 752.5, 856, 857, 869
See application file for complete search history.

(56) References Cited

U.S. PATENT DOCUMENTS 5,399,108 A * 3/1995 Lu et al. ..... 439/682
5,649,836 A * 7/1997 Kashiwagi ..... 439/342
5,730,606 A 3/1998 Sinclair
6,155,860 A * 12/2000 Lemke et al. ..... 439/341
6,908,328 B2 * 6/2005 Lei et al. ..... 439/342
7,052,289 B1 * 5/2006 Hao ..... 439/83
7,074,055 B2 * 7/2006 Yang et al. ..... 439/83
7,303,421 B2 * 12/2007 Liao ..... 439/342
2005/0202696 A1 * 9/2005 Hsiao et al. ..... 439/70
2006/0019509 A1 * 1/2006 Yang et al. ..... 439/73
2006/0258200 A1 * 11/2006 Hao ..... 439/342
2007/0059966 A1 * 3/2007 Liao ..... 439/342
2008/0101047 A1 * 5/2008 Wang et al. ..... 361/767

FOREIGN PATENT DOCUMENTS

CN 2598181 Y 1/2004

* cited by examiner

*Primary Examiner*—James Harvey
(74) *Attorney, Agent, or Firm*—Wei Te Chung

(57) ABSTRACT

A socket connector terminal (1) adapted for connecting an IC package to a PCB includes a base portion (10) for retaining, a pair of contacting portion (113) for connecting with the IC package, a pair of resilient arm (11) respectively connecting with the base portion and the contacting portions and a solder portion (12) for soldering on the PCB. The pair of resilient arms each includes a short bridge portion (111) extending outward from a lateral side of base portion and a resilient portion (112) extending upward from the bridge portion. The solder portion extends downwards from one of the bridge portion.

15 Claims, 5 Drawing Sheets

SOCKET CONNECTOR TERMINALS

BACKGROUND OF THE INVENTION

1. Field of the Invention

The present invention relates to a socket connector terminal, and particularly to a socket connector terminal adapted for electrical connection of a PGA (Pin Gray Array) electrical component to a PCB.

2. Description of Related Arts

FIGS. 1 and 2 shows a conventional socket terminal 9 used in a PGA socket connector for connecting an IC package to a PCB. Each terminal 9 is formed by bending a metal sheet. Each includes a base portion 91 for securing the terminal, a solder portion 92 perpendicularly bent at the bottom end of the base portion 91 and a pair of resilient arms 93 perpendicularly extending from two opposite lateral sides of the base portion 91. Each terminal further includes a contacting portion 94 at free end of each resilient arm 93 and a pair of retaining portions 95 extending from two opposite lateral sides of the base portion 91 below the resilient arms 93. The retaining portions 95 and the base portion are in the metal sheet plane, and the solder portion 92 and resilient arms 93 are perpendicular to the sheet plane.

The resilient arm 93 has a downward-extending portion 931 and an upward-extending portion 932 from the end of the downward-extending portion 931. The downward-extending portion 931 is helpful to increase the length of the upward-extending portion 932 so that the resilient force of the resilient arms will be increased.

However, the width of the whole terminal will increase while the downward-extending portion 931 extends further to lengthen the upward-extending portion 932, which will make every terminal require more metal strip, especially in the wide direction. And more, scraps during manufacturing process will become more.

CN Pat No. 2598181Y issued Molex on Jan. 7, 2004 disclose a socket terminal. The terminal includes three mutually perpendicular walls formed by bending a metal plate, main, left and right wall. A pair of contacting arm extend upwards from the top of the left and right wall. A solder pad perpendicularly bents inwards from the bottom of the left wall and a straight portion extends downward from the bottom of the right wall. The straight portion is helpful the solder of the solder pad.

However, the three walls of the terminal has no help to increase the contacting arms and more it will occupy a larger metal blank.

Hence, an improved socket connector terminal is desired.

SUMMARY OF THE INVENTION

Accordingly, an object of the present invention is to provide a socket connector terminal having good elasticity.

Another object of the present invention is to provide a socket connector terminal having smaller pitch.

To achieve the above objects, a socket connector terminal adapted for connecting an IC package to a PCB includes a base portion for retaining, a pair of contacting portion for connecting with the IC package, a pair of resilient arm respectively connecting with the base portion and the contacting portions and a solder portion for soldering on the PCB. The pair of resilient arms each includes a short bridge portion extending outward from a lateral side of base portion and a resilient portion extending upward from the bridge portion. The solder portion extends downwards from one of the bridge portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Further detailed description of the preferred embodiments of this present invention is set forth below along with the attached drawings.

Figure 1:
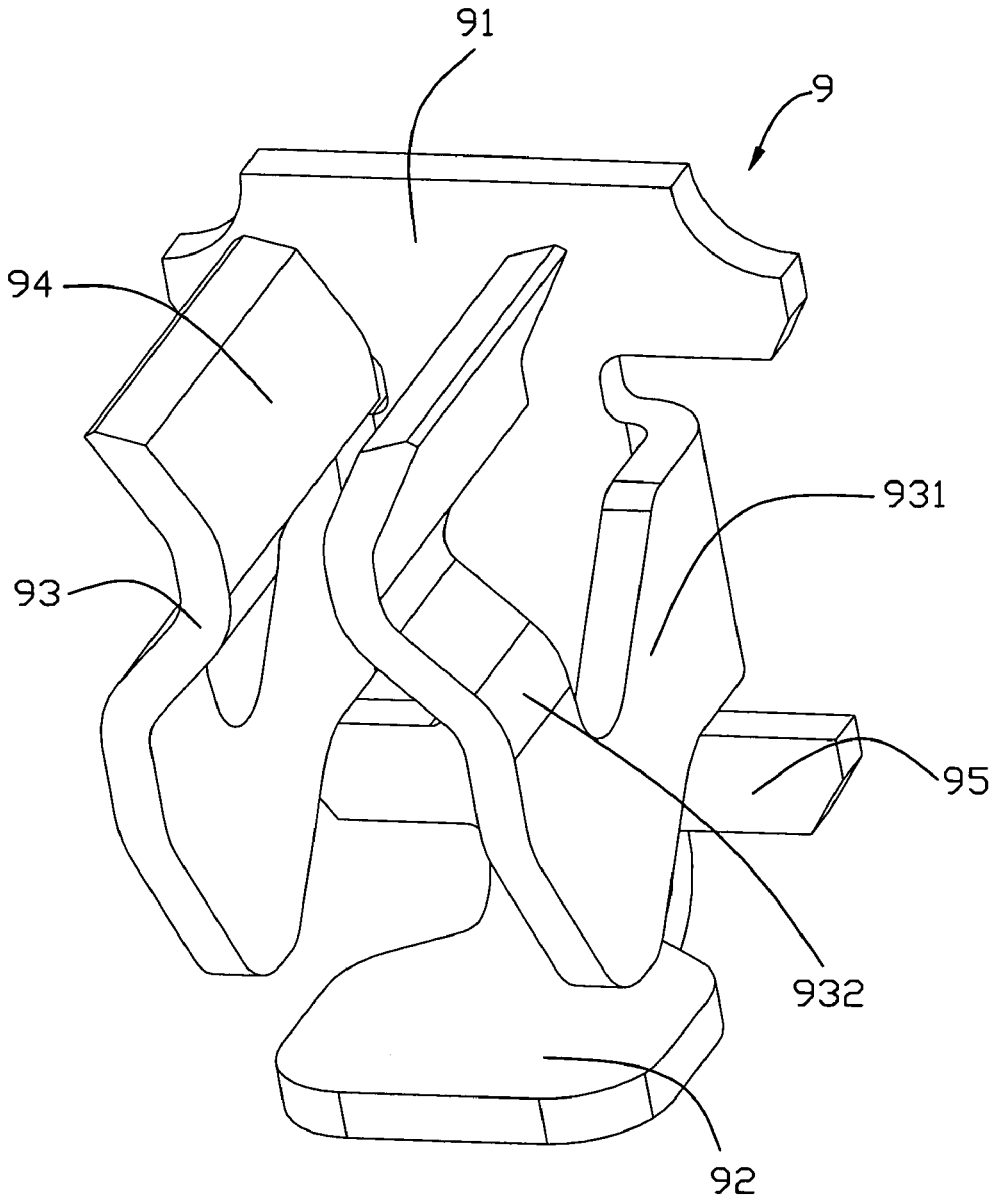
FIG. 1 (PRIOR ART)
FIG. 1 is a perspective view of a conventional terminal.
Figure 2:
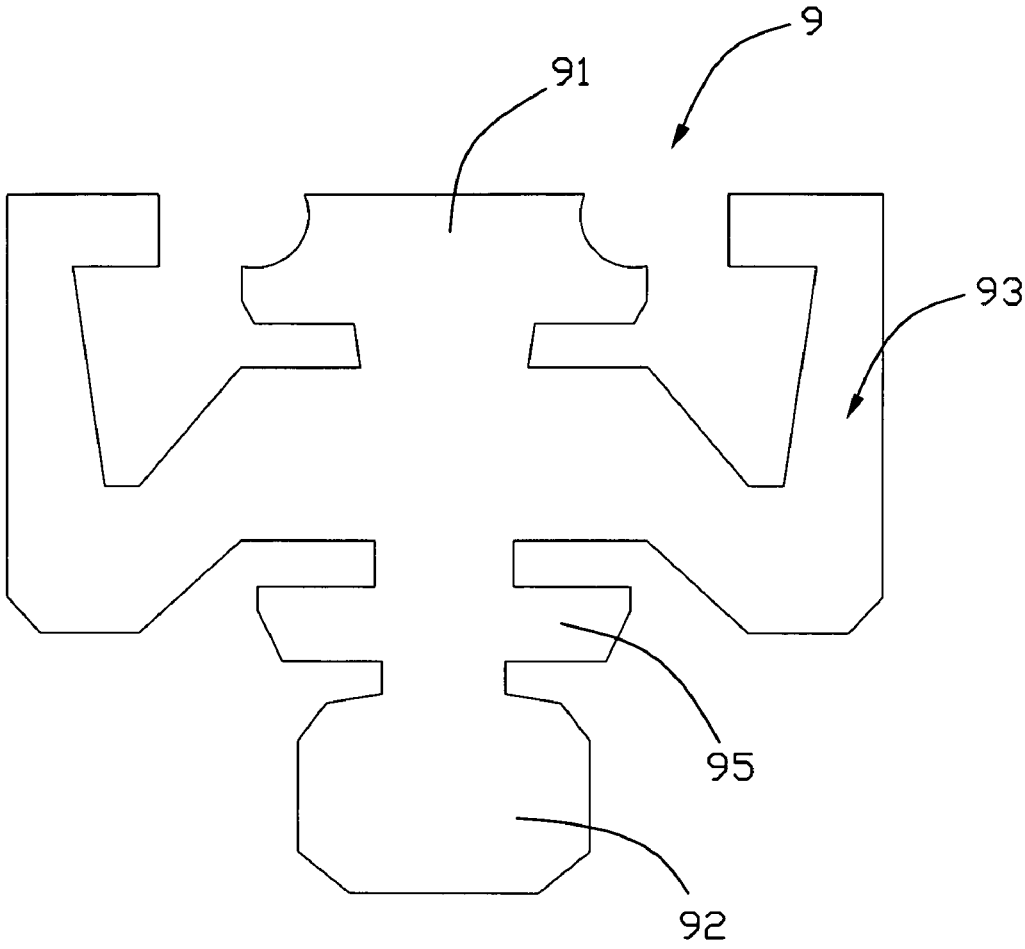
FIG. 2 (PRIOR ART)
FIG. 2 is a planar view of the terminal of FIG. 1 in the form of metal blank.
Figure 3:
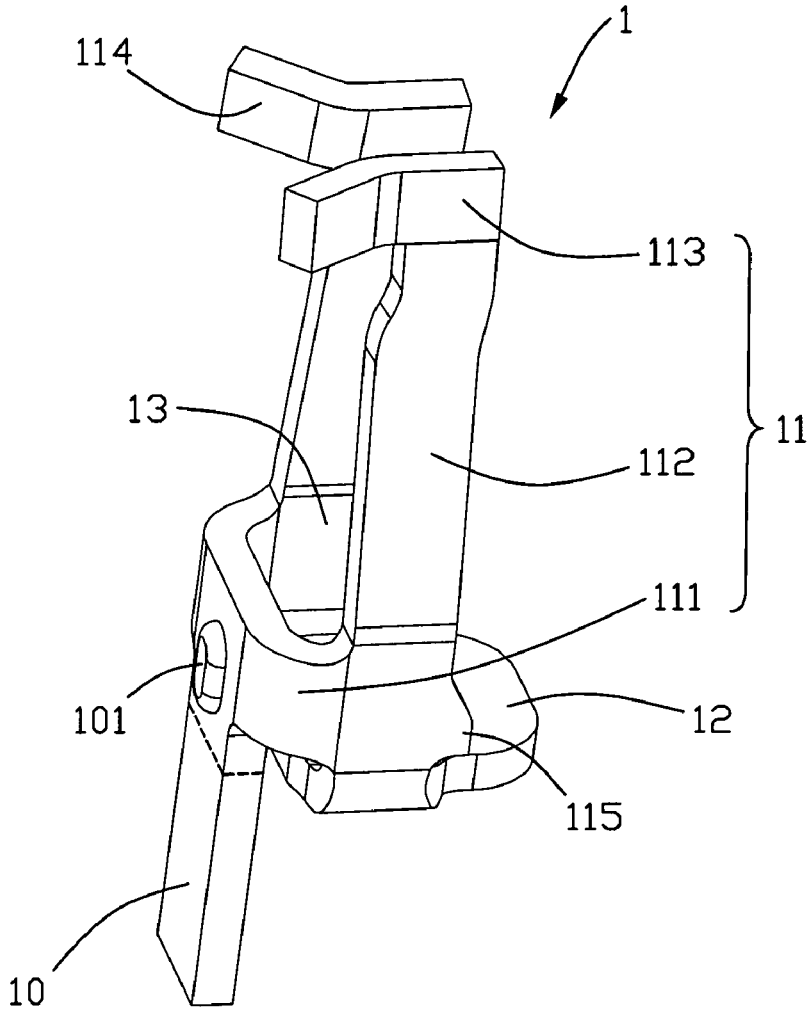
FIG. 3 is a perspective view of a socket connector terminal in accordance with the present invention.
Figure 4:
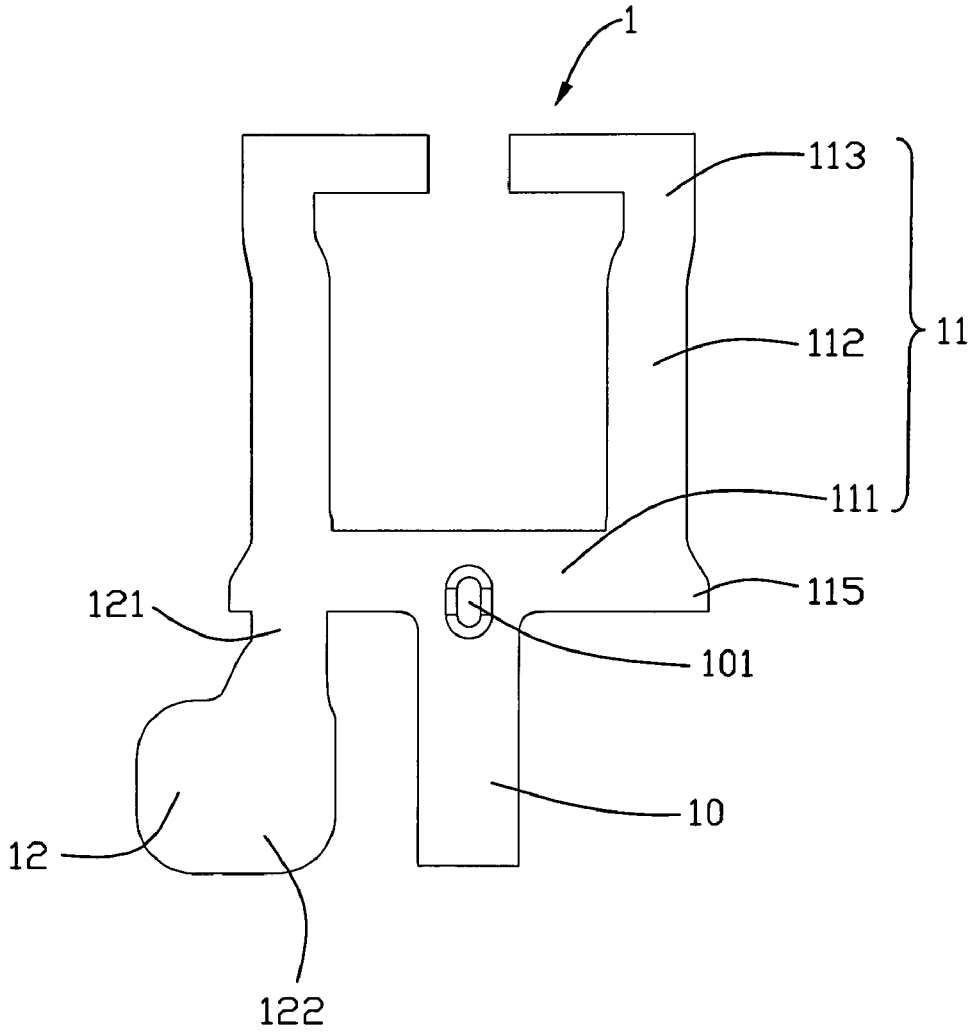
FIG. 4 is a perspective view of the terminal of FIG. 3 in the form of metal blank.

Referring to FIGS. 3 and 4, a socket connector terminal made in accordance with the present invention is adapted for a chip socket connector for connecting IC package to a PCB. The terminal 1 is stamped from a metal strip as shown in FIG. 4 first and then bent so as to form the terminal as shown in FIG. 3.

The terminal 1 comprises a longwise base portion 10, a pair of resilient arms 11 and a solder portion 12. The base portion defines a small protuberance 101 adjacent to a top end thereof. The pair of resilient arms 11 comprised a pair of short bridge portions 111 respectively extending from lateral sides of the base portion 10 at the top end thereof and substantially perpendicularly bend opposite to the protuberance 101. The pair of resilient arm 11 further includes a resilient portion 112 upright extending from a top edge of the bridge portion 111. The resilient portions are substantially perpendicular to the base portion 10 and slant toward each other to provide elasticity. A pair of contact portions 113 is disposed at the top free ends of each resilient portion 112 and has an outward free distal end 114, which forms a bugle-shaped insertion open. The base portion 10, the resilient portion 112 and the contacting portion 113 commonly defines a terminal-receiving space 13. The solder portion 12 bends into the terminal-receiving space 113. The solder portion 12 has a larger solder pad perpendicular to the base portion. The bride portions define barbs 115 at free end thereof. After the terminal assembled into an insulative housing, the bottom portion below dashed-line is cut off, which is connecting with a metal strip. Therefore, the bottom of the base portion after cutting is on a same plane of the bottom of the solder portion.

Referring to FIG. 4 showing the terminal blank before bending, the resilient arms 11 are disposed at the top end of the base portion 10 and symmetrical about the base portion. The length of the resilient portion 112 will be increased if distance between the top of the terminals and the bottom of the solder portion are predetermined. The bridge portion is provided only for connecting with the base portion, the resilient portion and solder portion so that it can be designed as short as possible. The solder portion has a connecting portion 121 and a larger pad 122. The connecting portion 121 is jointed with a bottom edge of the distal end of the bridge portion 111. The outermost of the larger pad 122 is beyond the outermost of resilient portion 112. Therefore, the width of each terminal is decreased. And more, the pitch of adjacent terminal becomes short and the scraps will become small.

Figure 5:
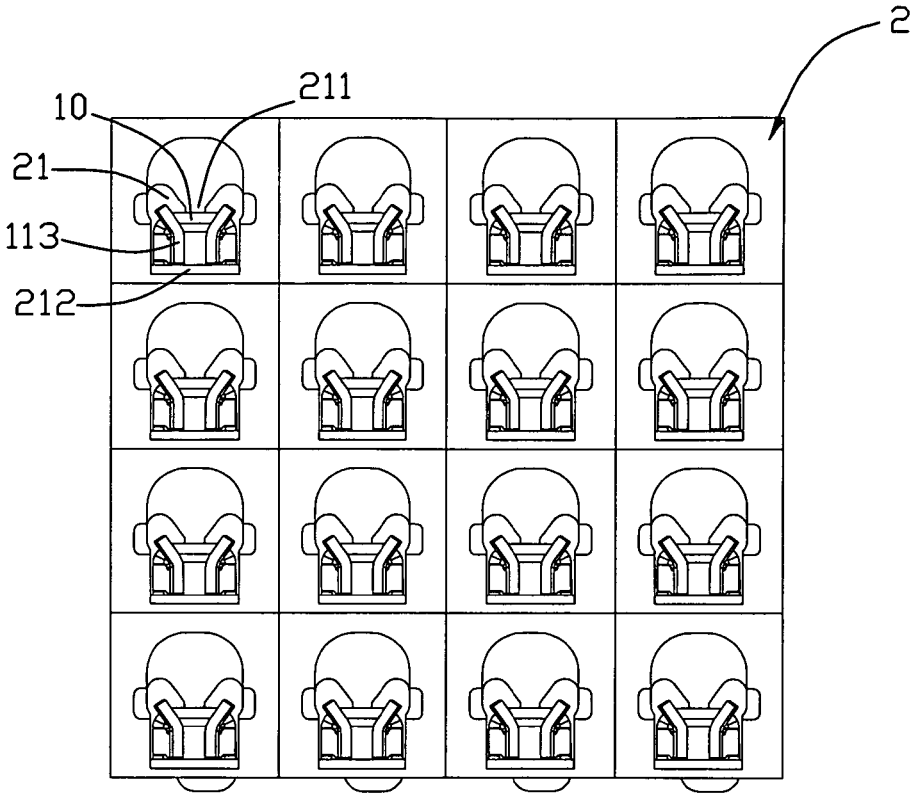
FIG. 5 is a perspective view of the terminal of FIG. 3 assembled in an insulating housing.

Referring to FIG. 5, the terminal 1 is inserted into the terminal passageway 21 of the insulating housing 2 from top. The protuberance 101 is interfered with a corresponding protrusion 211 on the back inside wall of the passageway 21. Barbs 115 of the terminals are interfered with step portions 212 on the front inside wall of the passageway 21. The free ends 114 of the contacting portions of the terminal 1 are not contact with the inside wall of the passageways 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A socket connector terminal adapted for connecting an IC package to a PCB, comprising:

a base portion having a retaining portion integrally formed thereof;

a pair of contacting arms for connecting with the IC package, a pair of bridge portions respectively extending outward from opposite lateral sides of base portion to connect with the contacting arms;

a solder portion for soldering on the PCB, extending from one of the bridge portions and having an edge closely to an edge of the base portion;

wherein said base portion extends below said solder portion.

2. The socket connector terminal as described in claim 1, wherein the bridge portions extends from a top lateral side of the base portion.

3. The socket connector terminal as described in claim 1, wherein a bottom edge of the bridge portion is higher than the a bottom edge of the base portion.

4. The socket connector terminal as described in claim 1, wherein the bridge portions each has a free end, the contact arms upright extend from the free ends of the bridge portion. tk

5. The socket connector terminal as described in claim 1, wherein the solder portion bends from a bottom edge of one bridge portion.

6. The socket connector terminal as described in claim 1, wherein the at least one of the pair of bridge portions and the solder portion are disposed in a same side of the base portion and substantially perpendicular to the base portion.

7. The socket connector terminal as described in claim 6, wherein the retaining portion are provide with a protuberance on another side of the base portion opposite the contacting arms.

8. The socket connector terminal as described in claim 1, wherein the bridge portion defines retaining portions at free distal ends thereof.

9. An electrical terminal blank comprising:

a base portion;

a pair of resilient arms, each defining a bridge portion extending from a lateral side of the base portion and a resilient portion extending substantially parallel and far from the base portion;

a pair of contacting portions, each inwardly extending form a top end of the resilient portion;

a solder pad extending from one bridge portion opposite to the resilient portion;

wherein said base portion extends below said solder portion.

10. The electrical terminal blank as described in claim 9, wherein the pair of the resilient arm is symmetrical about the base portion and the solder pad is non-symmetrical.

11. The electrical terminal blank as described in claim 10, wherein an outermost of solder pad is beyond the pair of contacting portions.

12. The electrical terminal blank as described in claim 9, wherein the base portion defines a protrusion at a top of the base portion.

13. The electrical terminal blank as described in claim 9, wherein the bridge portion defines a barb at its lateral free end.

14. The electrical terminal blank as described in claim 9, wherein the bridge portion is perpendicular to the base portion.

15. An electrical contact comprising:

a vertical retention section;

a pair of bridge portions laterally extending from two opposite sides of the retention section;

a pair of spring arms extending upwardly from the corresponding bridge portions, respectively;

a horizontal solder pad extending from one of said bridge portions opposite to the corresponding spring arm on the same bridge portion; and a pair of contact sections extending horizontally at upper ends of the pair of arms, respectively, said pair of contact sections defining an enlarged opening in a horizontal direction; wherein the enlarged opening is essentially located right above said vertical retention section, and other portions of said contact sections are essentially located right above the solder pad;

wherein said retention section extends below said solder portion.

* * * * *